US005199289A

United States Patent [19]

Hinson

[11] Patent Number: 5,199,289

[45] Date of Patent: Apr. 6, 1993

[54] COLLISION REPAIR RACK SYSTEM

[76] Inventor: Virgil H. Hinson, 206 Fairway Oaks Dr., Brunswick, Ga. 31523

[21] Appl. No.: 760,011

[22] Filed: Sep. 13, 1991

[51] Int. Cl.[5] ..... B21D 1/12

[52] U.S. Cl. ..... 72/457; 71/705

[58] Field of Search ..... 72/447, 457, 705

[56] References Cited

U.S. PATENT DOCUMENTS

| | | | |
|---|---|---|---|
| 3,583,203 | 6/1971 | Williams et al. . | |
| 4,189,934 | 2/1980 | Kuhn | 72/705 |
| 4,313,335 | 2/1982 | Eck . | |
| 4,370,882 | 2/1983 | Labbe . | |
| 4,398,410 | 8/1983 | McWhorter et al. . | |
| 4,592,225 | 6/1986 | Eck . | |
| 4,643,015 | 2/1987 | Larson et al. . | |
| 4,660,405 | 4/1987 | Widegren et al. | 72/705 |
| 4,700,599 | 10/1987 | Hanni et al. . | |
| 4,794,783 | 1/1989 | Eck . | |
| 4,932,236 | 6/1990 | Hinson . | |
| 5,027,639 | 7/1991 | Hinson . | |

FOREIGN PATENT DOCUMENTS

| | | | |
|---|---|---|---|
| 66904 | 7/1975 | Australia | 72/705 |

*Primary Examiner*—Lowell A. Larson

*Attorney, Agent, or Firm*—Jacobson, Price, Holman & Stern

[57] ABSTRACT

A vehicle repair support rack is provided of generally rectangular plan shape and including sharply rounded corner portions. Carriages are mounted from peripheral portions of the rack for movement thereabout and include outwardly projecting portions from whose outer extremities pull towers are supported for exerting a horizontal outward pull on a selected portion of a vehicle anchored to the rack. The rack includes vehicle support stands shiftable longitudinally and transversely of the opposite longitudinal margins of the support rack and the rack and support stands include simplified guide and locking structure which enable the stands to be quickly releasably locked in adjusted shifted positions along the stand.

13 Claims, 4 Drawing Sheets

FIG. 8
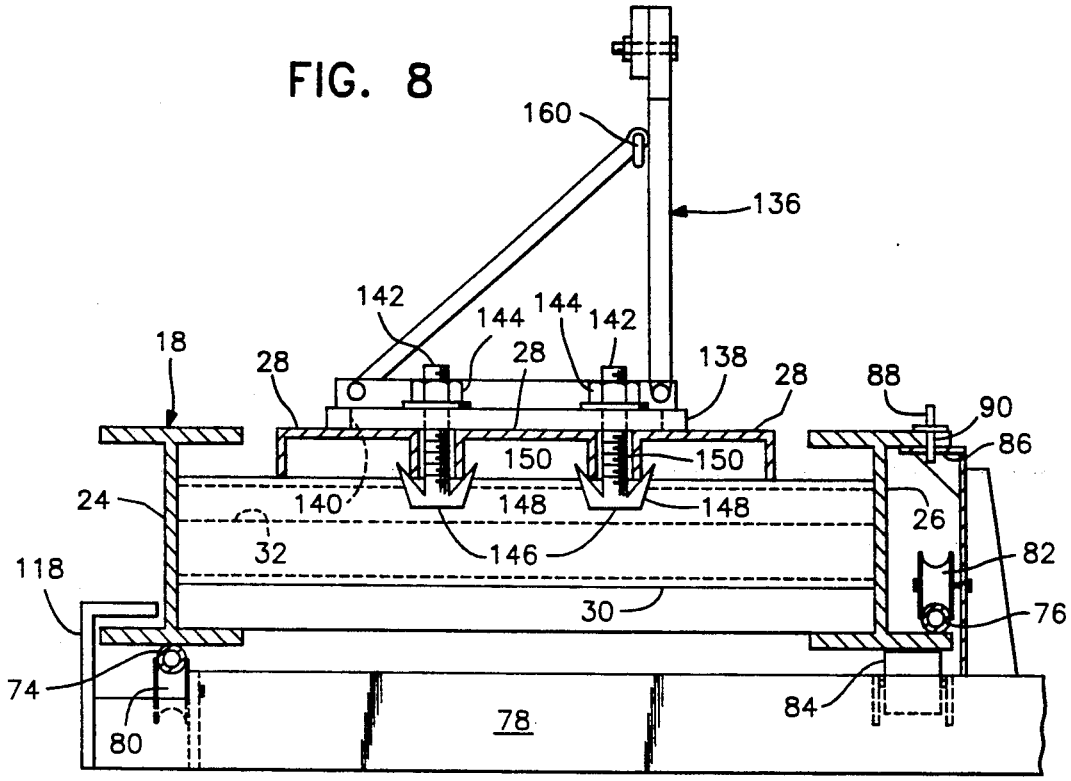
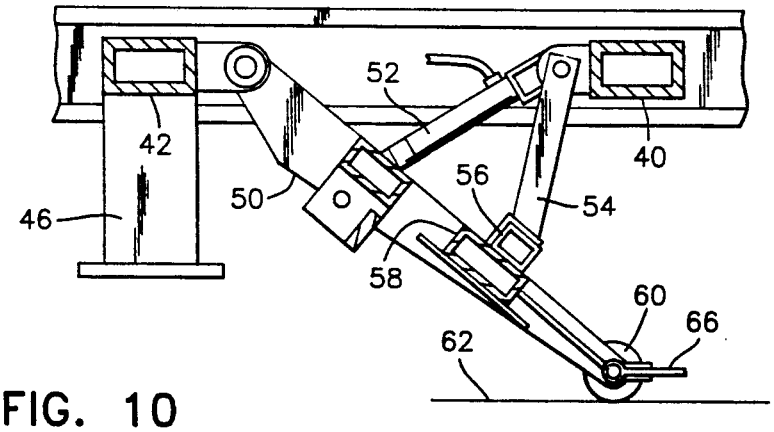
FIG. 9
FIG. 10
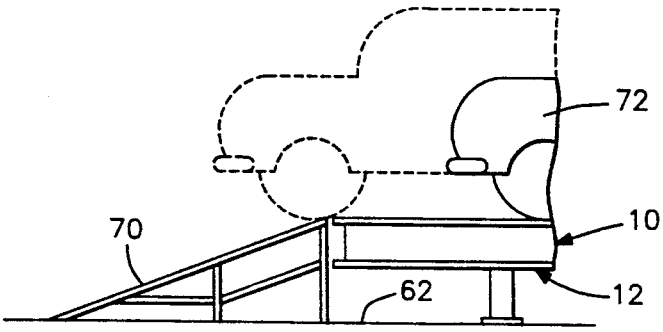

COLLISION REPAIR RACK SYSTEM

BACKGROUND OF THE INVENTION

1. Field of the Invention

This invention relates to a rack up on to which a vehicle may be moved and from which the vehicle may be stationarily supported for frame, sub-frame and body panel straightening and aligning purposes. The rack defines an outer periphery within the boundaries of which an associated vehicle upon which straightening and aligning work is to be performed may be supported and the outer periphery of the frame includes work platforms supported therefrom for guided movement thereabout and from which swivel pull towers are supported, which pull towers are basically constructed in the manner disclosed in my prior U.S. Pat. No. 5,027,639, but modified to include a simplified pull developing structure and horizontal pull height adjusting structure.

In addition, the rack is constructed in a manner whereby the work platforms may be moved along either side margin of the rack as well as at least one end thereof with the work platforms supported from the rack and movable about the periphery thereof in a manner such that the overall length of the rack may be reduced by approximately 22 percent of the width thereof at each end about which the work platforms ar movable to thereby enable the rack to be disposed and operated within a shorter overall work space.

Still further, the invention includes pinch weld clamp and support assemblies shiftable both longitudinally and laterally of the rack and including locking structure for releasably locking the pinch weld clamp and support assemblies in adjusted positions, the pinch weld clamp and support assemblies also being readily collapsible and providing vehicle drive over capability when collapsed.

2. Description of Related Art

Various different forms of support racks including some of the general structural and operational features of the instant invention are disclosed in U.S. Pat. Nos. 3,583,203, 4,313,335, 4,370,882, 4,398,410, 4,592,225, 4,643,015, 4,700,599, 4,794,783, 4,932,236 and 5,027,639. However, these previously known devices do not include combinations of structure as incorporated in the instant invention.

SUMMARY OF THE INVENTION

The collision repair rack system of the instant invention has been designed to facilitate the application of frame, sub-frame and/or body panel pulls on a vehicle being repaired. The support rack component of the system incorporates features which facilitate the application of such repair pulls throughout the entire repair process, including the loading of a vehicle on the repair rack, stationary anchoring of the vehicle in an elevated position relative to the rack and the placement of one or more pull towers about the vehicle on the repair rack as well as adjustment of the pull tower or towers relative to the vehicle in order to exert desired angle pulls thereon or horizontal pulls thereon at selected heights relative to the vehicle.

The main object of this invention is to provide a vehicle repair rack upon which a vehicle to be repaired may be loaded, stationarily anchored in elevated position relative to the rack and have various angle pulls exerted thereon through the utilization of pull towers capable of effecting an angle pull as well as horizontal pulls at selected elevations.

Another object of this invention is to provide a repair rack system which may be contained within a shorter working space.

Still another important object of this invention is to provide a repair rack system which may be utilized to support a vehicle to be worked upon at various elevations.

A further object of this invention is to provide a repair rack system incorporating collapsible, drive over type pinch weld clamp and a support assemblies which may be readily adjusted both longitudinally of the rack and transversely thereof and effectively locked in adjusted position.

A final object of this invention to be specifically enumerated herein is to provide a repair rack system in accordance with the preceding objects and which will conform to conventional forms of manufacture, be of simple construction and easy to use so as to provide a device that will be economically feasible, longlasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8 is an enlarged fragmentary vertical sectional view illustrating the manner in which one of the pinch weld clamp and supports is mounted from the rack for longitudinal and transverse shifting relative thereto and also the manner in which the pinch weld clamp and support may be locked in adjusted position;

FIG. 9 is a fragmentary longitudinal vertical sectional view illustrating the manner in which the support rack may be elevated and locked in two different elevated positions relative to the associated floor; and FIG. 10 is a fragmentary side elevational view illustrating the manner in which a vehicle may be moved up onto and down from the rack when the latter is supported from the floor in its lowermost position relative thereto.

DESCRIPTION OF THE PREFERRED EMBODIMENT

Figure 1:
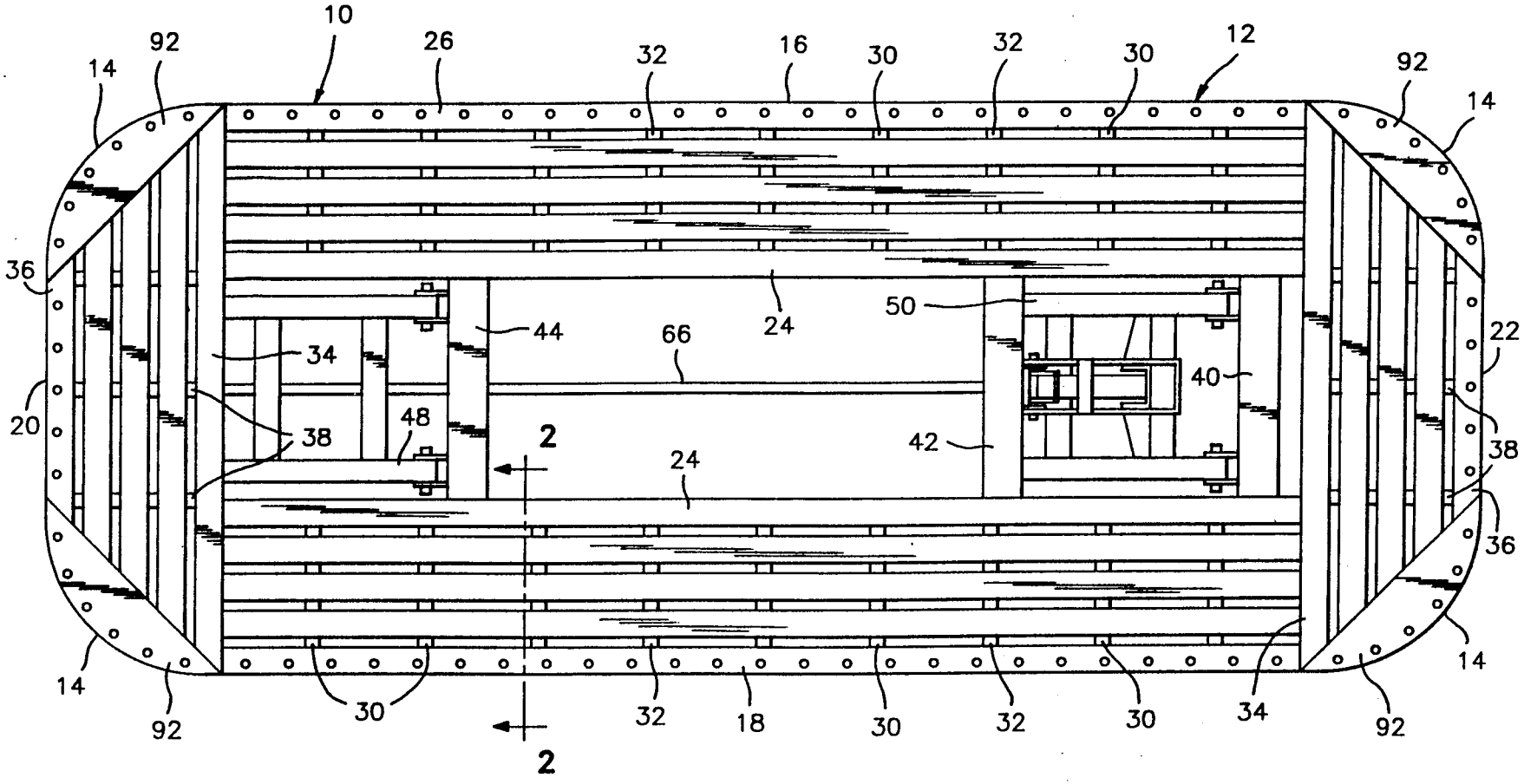
FIG. 1 is a top plan view of the rack component of the repair rack system of the instant invention.

Referring now more specifically to the drawings and the FIG. 1 in particular, the reference numeral 10 generally designates the collision repair rack system of the instant invention. The system 10 includes a rack referred to in general by the reference numeral 12 which is substantially rectangular in plan shape but includes for short radius of curvature corner portions 14. The rack 12 therefore includes long opposite side portions 16 and 18 as well as short opposite end portions 20 and 22, the corner portions 14 interconnecting adjacent ends of the end portions 20 and 22 and the opposite side portions 16 and 18.

As may be seen from FIG. 8 of the drawings each side portion 16 and 18 includes inner and outer peripheral beams 24 and 26 and a plurality of longitudinally extending tread way beams 28 spaced between the beams 24 and 26 and supported from short transverse beams 30 extending and secured between each pair of inner and outer beams 24 and 26. In addition to the transverse beams 30, each opposite side portion 16 and 18 includes two additional transverse beams 32 spaced therealong and extending between the inner and outer beams 24 and 26, but which are shorter in height than the transverse beams 30 for a purpose to be hereinafter more fully set forth.

The opposite end portions 20 and 22 include inner and outer beams 34 and 36 corresponding to the beams 24 and 26 and also transverse interconnecting beams 38 corresponding to the beams 30.

One end of the rack 12 includes a pair of transverse beams 40 and 42 extending between the inner beams 24 and the other end of the rack includes a transverse beam 44 extending between the beams 24.

The beams 42 and 44 each include a pair of opposite end depending stationary legs 46 and a first leg assembly 48 is pivotally mounted from the beam 44 while a second leg assembly 50 is pivotally mounted from the beam 42 and hydraulic actuating assembly 52 is operatively connected between the beam 4 and the leg assembly 50 for raising and lowering the latter, the leg assembly 50 including a prop 54 pivotally mounted from beam 40 and which alternately may engage stops 56 and 58 to lock the leg assembly 50 in selected lowered positions, the leg assemblies 48 and 50 including lower end rollers 60 for engagement with the underlying floor 62 and a connecting rod 66 being operatively connected between the leg assemblies 48 and 50 whereby the leg assembly 48 is selectively positioned in unison with selected positioning of the leg assembly 50. The leg assemblies 48 and 50 and the connecting rod 66 being substantially identical to the corresponding structure disclosed in my U.S. Pat. No. 5,027,639.

Either end (or both ends) of the rack 12 may have a loading ramp 70 temporarily operatively associated therewith whereby a vehicle 72 may be loaded onto or unloaded from the rack 12 when the latter is in its lowest position relative to the floor 62 as illustrated in FIG. 10 and the inner and outer beams 24, 26, and 34, 36 include guide rails or tracks 74 and 76 supported therefrom. A plurality of carriages 78 (only one is illustrated) are equipped with grooved wheels 80 and 82 rollingly engaged with the guide rails 74 and 76 and also are equipped with anti-friction rollers 84 for rolling engagement with the underside of the outer beams 26 and 36. Here again, the structure and operation of the guide rails 74 and 76 and the carriages 78 as well as the grooved rollers 80 and 82 and the anti-friction rollers 84 is similar to that disclosed in my above mentioned prior patent. Further, the carriages 78 include horizontal flanges 86 which underlie the upper flanges of the outer beams 26 and 36 and with which lock pins 88 may be operatively associated and inserted through apertures 90 spaced along the outer peripheral portions of the outer beams 26 and 36 and also spaced along the curved plates 92 defining the curved portions 14 which join adjacent ends of the outer opposite side and end beams 26 and 36.

Accordingly, the inner end portions of the carriages 78 include rollers 80 engaged with the guide rails 74, the intermediate length portions of the carriages 78 include grooved rollers 82 engaged with the guide rails 76 and the outer end portions of the carriages 78 include pull towers referred to in general by the reference numerals 94 pivotally supported therefrom as at 96, all of which structure is substantially identical to the pull tower and carriage structure disclosed in my above mentioned prior patent.

The pull towers 94 differ from the pull towers disclosed in my above mentioned prior patent in that the upper pulley 98 over which the pull chain 100 is passed is carried by a vertical slide mounted on the vertical leg 104 of the pull tower 94 and the vertical slide 102 is supportive from one end of a chain 106 which passes over a top pulley 108 journaled from the upper end of the vertical leg 104, the other end of the chain 106 having its links selectively engagable in an anchor slot 110 carried by a reinforced anchor bracket 112 mounted from the upper end of the vertical leg 102 in position spaced below the top pulley 108. In this manner, a horizontal pull exerted by the pull chain 100 may be adjusted in elevation relative to the corresponding carriage 78. The pull tower 94, and particularly the lower horizontally leg 113 thereof, otherwise is substantially identical to the pull tower disclosed in my above mentioned prior patent.

Figure 4:
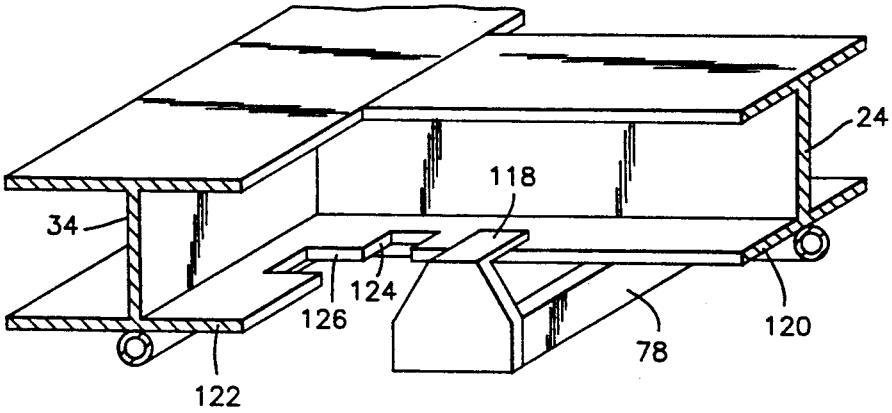
FIG. 4 is an enlarged fragmentary perspective view illustrating the manner in which the inner end of each pull tower support platform and the inner marginal periphery of the support rack, at the corners thereof, are constructed in order to enable the pull support platforms to negotiate a short radius of curvature turn about the corners of the rack.
Figure 5:
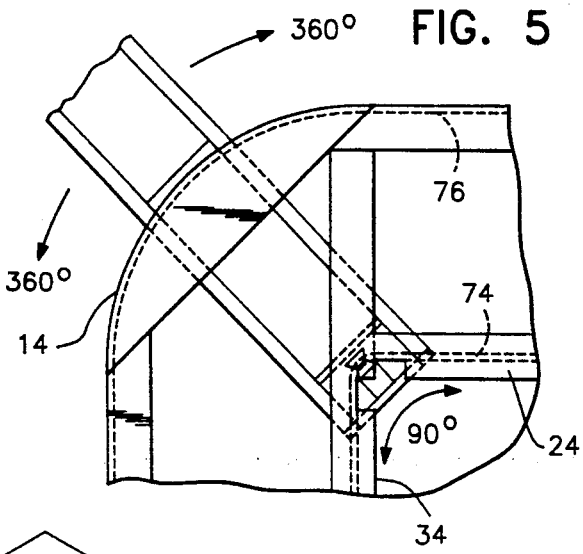
FIG. 5 is a fragmentary skeletal top plan view of one corner portion of the rack and fragmentarily illustrating a pull tower support platform in the manner in which it moves about the rack corner portion.
Figure 6:
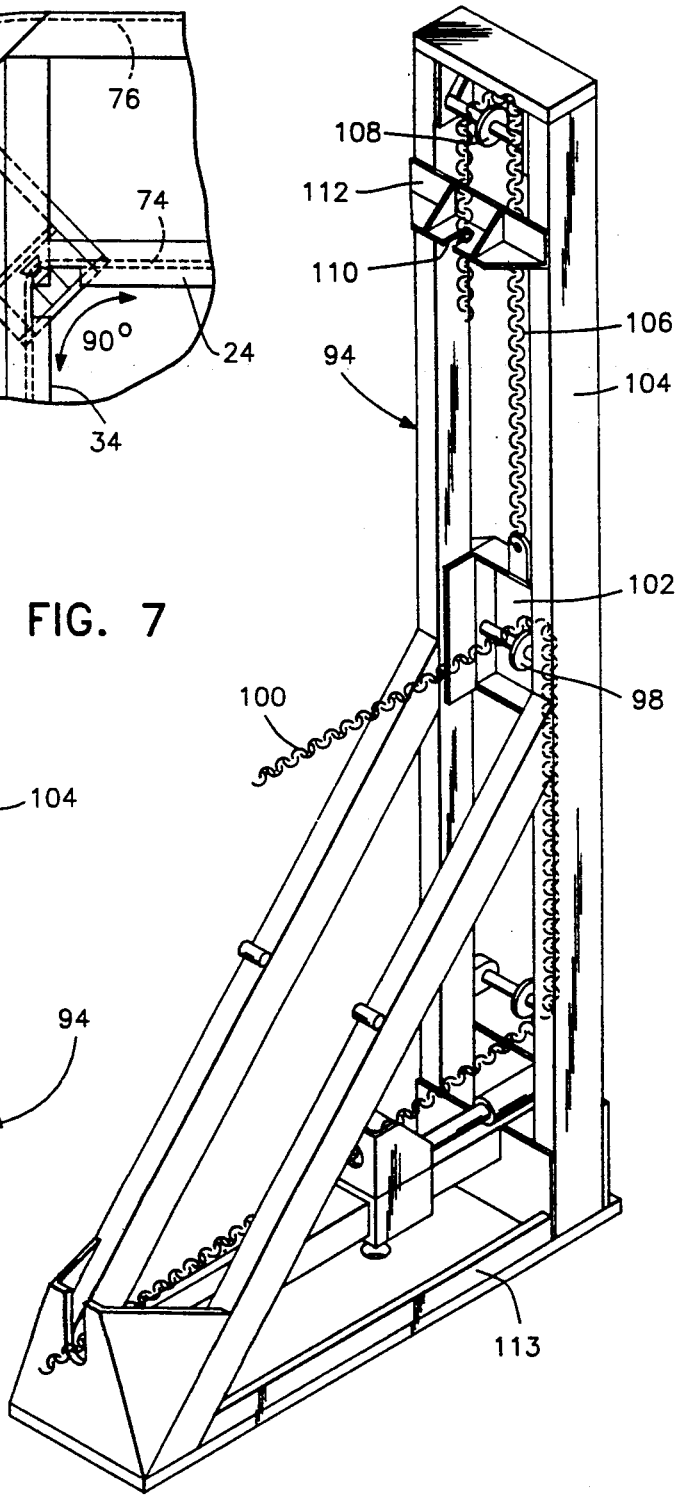
FIG. 6 is an enlarged fragmentary perspective view of the upper portion of one of the pull towers illustrating the manner in which the height of a horizontal pull to be exerted may be readily adjusted.
Figure 7:
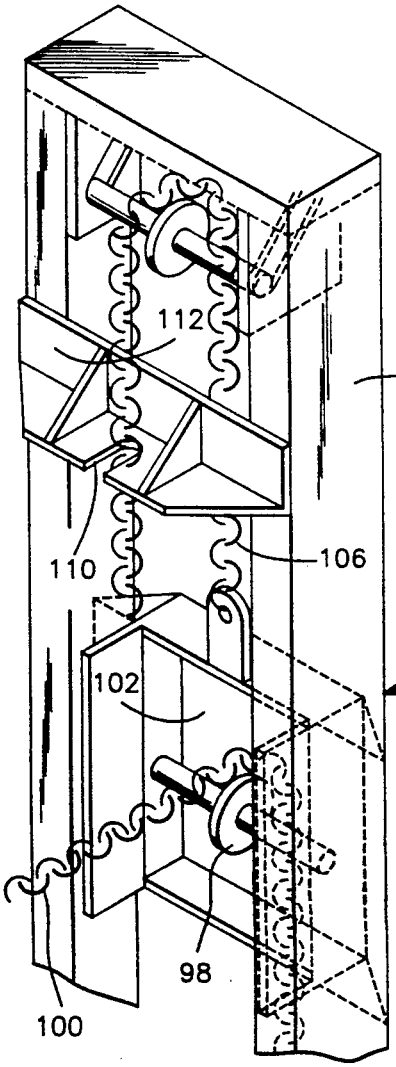
FIG. 7 is a perspective view of one of the pull towers.

With attention now invited more specifically to FIGS. 4 and 5 of the drawings, it may be seen that the inner guide rail 74 executes a very sharp, substantially 90 degree turn at the intersection between each inner beam 24 and the adjacent end of the corresponding inner beam 34 and that the guide rail 76 executes a reasonably sharp radius turn about each corner portion 14. However, the L-shaped bracket 118 which closely overrides the inner periphery of the lower flanges 120 and 122 of the inner beams 24 and 34 would prevent the inner ends of the carriages 78 from executing the sharp corners at the intersections between the beams 24 and 34. Accordingly, the lower flanges 120 and 122 are notched as at 124 and 126, whereby as the inner end of the carriage 78 approaches the beam 34 the L-shaped bracket 118 may first enter the notch 126 and become seated therein while the outer end of the carriage 78 begins to traverse the corresponding curved portion 14. As the roller 82 moves along that portion of the guide rail 76 extending about the curved portion 14, the L-shaped bracket 118 gradually will move out of the notch 126 and into the notch 124 as the outer end of the carriage 78 approaches the end of the curved portion 14 adjacent the corresponding outer end beam 20. Then, after the carriage has assumed position substantially normal to the end beam 34 and moves along the latter, the L-shaped 118 will move out of the notch 124 and thereafter downwardly along the lower flange 122 of the beam 24.

The L-shaped bracket 118 is required in order to brace the inner end of the carriage 78 relative to the corresponding inner beam when a horizontal pull is being exerted by the corresponding pull tower 94.

By notching the flanges 120 and 122 to provide clearance for the L-shaped bracket 118, the carriage 78 may have its inner end maintained substantially stationary while the intermediate length portion thereof traverses one of the corner portions 14. This enables the carriage 78 to be more quickly angularly displaced 90 degrees and thus the same width rack 12 to include almost one-half width straight opposite end portions 20 and 22 as opposed to the 180 degree half width radius turns executed by the carriages disclosed in my above noted prior patent.

In actuality, the shorter radius turns of the carriages 78 of the instant invention enable a double-ended rack such as that designated by the reference numeral 12 to be of a length which is substantially shorter than the length of the rack disclosed in my above mentioned prior patent. The actual saving in length is equal to approximately 45 percent of the width of the rack 12. In addition, because of the straight beams 36 extend almost one-half the width of the rack 12, heavy duty longitudinal pulls may be exerted on a vehicle frame more readily throughout approximately the center half of the width of the rack 12.

Figure 2:
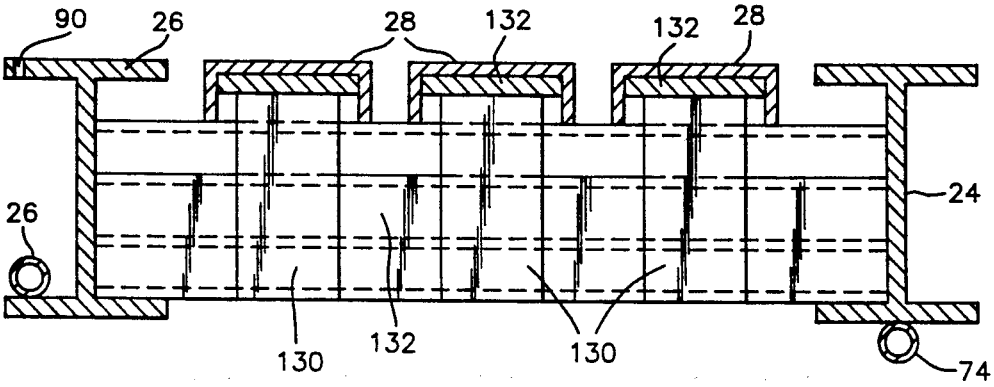
FIG. 2 is an enlarged fragmentary vertical sectional view taken substantially upon the plane indicated by the section line 2—2 of FIG. 1.
Figure 3:
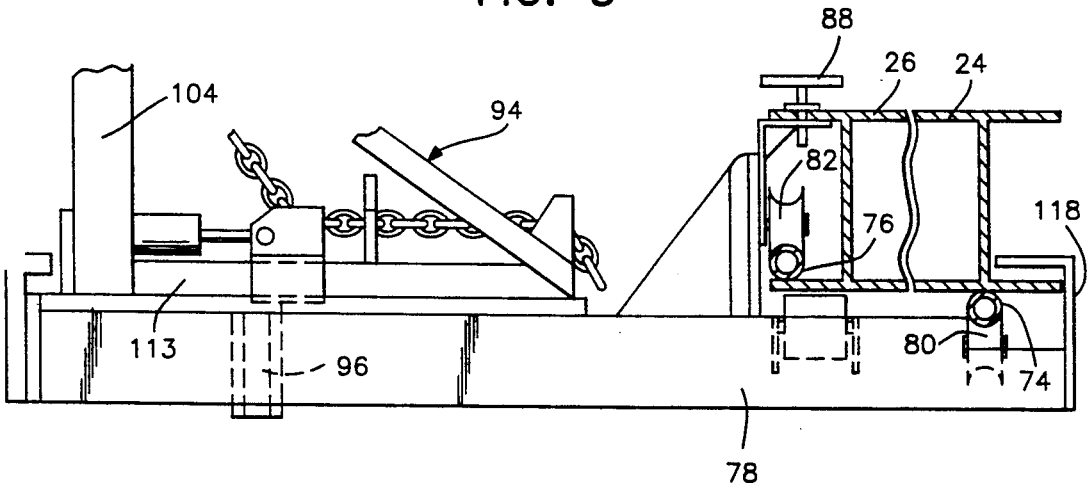
FIG. 3 is an enlarged fragmentary transverse vertical sectional view illustrating the manner in which one of the pull tower supporting platforms is mounted from the rack periphery for movement thereabout and also the manner in which the supported pull tower is mounted from the platform for angular displacement thereto about a vertical axis.

Referring now more specifically to FIG. 8, it may be seen that the treadway beams 28 rest upon and are secured to the upper portions of the transverse beams 30. However, with attention invited more specifically to FIG. 2, those portions of the treadway beams 28 extending over the transverse beams 32 are supported therefrom by vertical plates 130 secured to the transverse beams 132, projecting thereabove and having short plates 132 secured to the upper ends thereof extending longitudinally of the rack 12 and to which the overlying portions of the treadway beams 28 are secured. Of course, the vertical plates 32 are spaced inward from the adjacent sides of the treadway plates 28.

The system 10 additionally includes a plurality of vehicle support stands referred to in general by the reference numerals and which are substantially identical in construction to the corresponding support stands disclosed in my above mentioned prior patent. The support stands 136 differ from my previous support stands in that the base plates 138 thereof include opposite longitudinal slots 140 formed therein upwardly through which the threaded shank portions 142 of headed anchors extend, the shank portions 142 having threaded nuts 144 threadedly engaged thereon. The shanks 142 extend downward between adjacent pairs of treadway beams 28 and include heads 146 defining opposite side upwardly opening grooves 148 which receive therein the lower margins of the depending flanges 150 of adjacent treadway beams 28. In this manner, the nuts 140 may be loosened to allow the stands 136 to be shifted longitudinally of the treadway beams 128 and also transversely thereof into the desired adjusted positions. Then, the nuts 144 may be tightened.

There are two pair of opposite side stands 136 provided on the rack 12 and each stand 136 is shiftable longitudinally over the corresponding transverse beam 32 and between the adjacent transverse beams 30. However, if desired, the nuts 144 of a given stand 136 may be completely removed and that stand 136 may be reinstalled between any pair of adjacent transverse beams 32.

The stands 136 include removable locking pins 160 whereby the stands may be collapsed and actually driven over when moving a vehicle onto or from the rack 12. In addition, the anti-friction rollers 84 serve the same purpose as the corresponding rollers disclosed in my above mentioned prior U.S. patent and suitable lock means (not shown) may be utilized to maintain the lower horizontal leg 113 of each pull tower 94 in adjusted angularly displaced position relative to the outer end of the corresponding carriage 78.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A vehicle repair support rack including an outer peripheral portion incorporating two generally straight opposite longitudinal side portions and at least one generally straight end portion joined to one pair of corresponding ends of said side portions by relatively small radius of curvature rounded corner portions, said outer peripheral portion defining track structure extending thereabout, at least one carriage guidingly engaged with said track structure for support therefrom and adjustment therealong, said carriage and track structure including coacting lock means operative to releasably lock said carriage in selected adjusted positions along said track structure, said side, end and corner portions each including inner and outer margins, said track means including inner and outer tracks extending along said inner and outer margins, said carriage being elongated in a direction transverse relative to said inner and outer margins and including inner and outer ends, said inner end including follower means guidingly engaged with said inner track, said outer end including a pull tower supported therefrom spaced outward of said outer margin and an intermediate length portion of said carriage including follower means guidingly engaged with said outer track, said inner track including a structural member extending along each of said end and longitudinal side portions and including a horizontal longitudinal flange having an inner marginal edge, said flanges intersecting at generally right angles at said corner portions, said inner track means also including elongated, straight track member sections extending along and supported from and beneath said flanges outward of said inner marginal edges, said track member sections being joined at said corner portions by short radius of curvature curved track member sections, said inner end of said carriage underlying the corresponding flange and inner marginal edge and having the corresponding follower means supported therefrom and guidingly engaged with the corresponding track member section, said inner end of said carriage also including an upwardly projecting bracket disposed closely inward of said inner marginal edge and including an upper inwardly directed safety portion closely overlying the corresponding flange, the inner marginal edge of each of said flanges, at the intersections of said end structural member and the adjacent ends of said side structural members being notched to provide clearance for said bracket as said inner end follower means moves about the corresponding short radius of curvature curved track member section.

2. The vehicle repair support rack of claim 1 wherein each longitudinal side portion includes laterally spaced longitudinally extending treadway beams spaced between inner and outer beams from which said corresponding portions of said track member sections are supported and supported from transverse beams extending between and spaced along said inner and outer beams, and a vehicle support stand mounted from said treadway beams, said vehicle support stand and treadway beams including combined guide and lock means operative to guide said vehicle support stand for shifting longitudinally and transversely of said treadway beams and to releasably lock said vehicle support stan in adjusted shifted position relative to said treadway beams.

3. The vehicle repair support rack of claim 2 wherein some of said transverse beams include means operative to prevent shifting of said vehicle support stand therepast.

4. The vehicle repair support stand of claim 3 wherein at least one of said transverse beams is ineffective to prevent shifting of said vehicle support stand therepast.

5. The vehicle repair support stand of claim 2 wherein said vehicle support stand includes an upwardly projecting vehicle engaging and support portion thereof downwardly retractable into horizontal "drive-over" position enabling a wheeled vehicle on said rack to be rolled over said vehicle support stand, when the latter is downwardly retracted, while a loading a vehicle onto said rack or unloading a vehicle therefrom.

6. The vehicle repair support rack of claim 2 wherein said treadway beams comprise inverted U-shaped beams and include depending opposite side flanges, said vehicle support stand including a base plate overlying said treadway beams, said guide and lock means including a slot formed in said base plate extending in a direction transverse to said treadway beams, a threaded shank loosely extending upwardly between side flanges of adjacent treadway beams and upwardly through said slot, a head carried by the lower end of said shank including parallel upwardly opening grooves in which the lower marginal edges of the last mentioned flanges are received, and a threaded abutment threaded on the upper end of said shank above said slot.

7. The vehicle repair support stand of claim 2 wherein said pull tower includes a lower horizontal leg overlying and generally paralleling the outer end of said carriage and supported from the latter for limited angular displacement about an vertical axis, said pull tower also including a vertical leg extending upwardly from the outer end of said horizontal leg, said vertical leg including an intermediate height portion thereof from which a slide is mounted from guided shifting therealong, said slide including a pulley journal therefrom for rotation about a horizontal axis and having a pull chain passed thereover, an upper portion of said vertical leg having a top pulley journaled therefrom over which a flexible tension member is passed, one end of said tension member depending downwardly from said top pulley and being anchored to said slide and the other end portion of said tension member including longitudinally spaced portions thereof selectively removably anchorable with an anchor brace carried by said vertical leg spaced vertically below said top pulley.

8. The vehicle repair support rack of claim wherein said slide and anchor brace are supported from opposite sides of said vertical leg facing away from and toward, respectively, the end of said horizontal leg remote from said vertical leg.

9. An elongated vehicle repair support rack including generally straight opposite side longitudinal portions, said opposite longitudinal portions each being defined by a pair of inner and outer longitudinal beams having a plurality of transverse beams extending and secured therebetween spaced along said longitudinal beams, a plurality of treadway beams paralleling said inner and outer beams and laterally spaced apart between the latter, adjacent treadway beams including adjacent depending flanges, a vehicle support stand disposed over said treadway beams and including a base plate, said treadway beams and base plate including guide and lock means mounting said base plate from said treadway beams for adjusted shifting longitudinally of the latter as well as transversely of the latter, said guide and lock means including a slot formed in said base plate extending in a direction transverse to said treadway beams, a threaded shank loosely extending upwardly between the flanges of adjacent treadway beams and upwardly through said slot, a head carried by the lower end of said shank defining parallel grooves in which the lower marginal edges of said flanges are received, and a threaded abutment threaded on the upper end of said shank projecting above said slot.

10. The support rack of claim 9 wherein some of said transverse beams include means operative to prevent shifting of said vehicle support stand therepast.

11. The support rack of claim 10 wherein at least one of said transverse beams is ineffective to prevent shifting of said vehicle support stand therepast.

12. An elongated vehicle repair support rack including generally straight opposite side longitudinal portions, said opposite longitudinal portions each being defined by a pair of inner and outer longitudinal beams having a plurality of transverse beams extending and secured therebetween spaced along said longitudinal beams, a plurality of treadway beams paralleling said inner and outer beams and laterally spaced apart between the latter, adjacent treadway beams including adjacent depending flanges, a vehicle support stand disposed over said treadway beams and including a base plate, said treadway beams and base plate including guide and lock means projecting through said base plate and between said treadway beams operative to guide said vehicle support stand for shifting longitudinally and transversely of said treadway beams and to releasably lock said vehicle support stand in adjusted shifted position relative to said treadway beams, said vehicle support stand including a base plate overlying said treadway beams, said guide and lock means including a slot formed in said base plate extending in a direction transverse to said treadway beams, a threaded shank loosely extending upwardly between side flanges of adjacent treadway beams and upwardly through said slot, a head carried by the lower end of said shank including parallel upwardly opening grooves in which the lower marginal edges of the last mentioned flanges are received, and a threaded abutment threaded on the upper end of said shank above said slot.

13. The vehicle repair support rack of claim 12 wherein said vehicle support stand includes an upwardly projecting vehicle engaging and support portion thereof downwardly retractable into horizontal "drive-over" position enabling a wheeled vehicle on said rack to be rolled over said vehicle support stand, when the latter is downwardly retracted, while a loading a vehicle onto said rack or unloading a vehicle therefrom.

* * * * *